US009524687B2

(12) United States Patent
Choi et al.

(10) Patent No.: US 9,524,687 B2
(45) Date of Patent: Dec. 20, 2016

(54) METHOD OF DRIVING A DISPLAY PANEL, DISPLAY PANEL DRIVING APPARATUS FOR PERFORMING THE METHOD AND DISPLAY APPARATUS HAVING THE DISPLAY PANEL DRIVING APPARATUS

(71) Applicant: Samsung Display Co., Ltd., Yongin, Gyeonggi-Do (KR)

(72) Inventors: Hak-Mo Choi, Seoul (KR); Gwang-Ho Nam, Asan-si (KR); Hoi-Sik Moon, Asan-si (KR); Min-Yup Chae, Cheonan-si (KR); Jae-Seok Choi, Uijeongbu-si (KR)

(73) Assignee: Samsung Display Co., Ltd. (KR)

( * ) Notice: Subject to any disclaimer, the term of this patent is extended or adjusted under 35 U.S.C. 154(b) by 220 days.

(21) Appl. No.: 14/315,045

(22) Filed: Jun. 25, 2014

(65) Prior Publication Data

US 2015/0206497 A1 Jul. 23, 2015

(30) Foreign Application Priority Data

Jan. 22, 2014 (KR) ..... 10-2014-0007854

(51) Int. Cl.
*G09G 5/00* (2006.01)
*G09G 3/36* (2006.01)

(52) U.S. Cl.
CPC ..... *G09G 3/3677* (2013.01); *G09G 3/3648* (2013.01); *G09G 2300/04* (2013.01); *G09G 2310/061* (2013.01); *G09G 2320/0223* (2013.01)

(58) Field of Classification Search
CPC ..... G09G 3/3648; G09G 3/3696
USPC ..... 345/204, 211–212, 690
See application file for complete search history.

(56) References Cited

U.S. PATENT DOCUMENTS

| | | | | |
|---|---|---|---|---|
| 5,844,536 | A | 12/1998 | Okada et al. | |
| 5,995,074 | A * | 11/1999 | Kusafuka | G09G 3/3648 345/210 |
| 7,696,974 | B2 | 4/2010 | Moon et al. | |
| 8,330,695 | B2 * | 12/2012 | Irie | G09G 3/3614 345/209 |
| 2008/0186298 | A1 | 8/2008 | Mamiya et al. | |
| 2010/0134460 | A1 * | 6/2010 | Hashimoto | G09G 3/3648 345/211 |

FOREIGN PATENT DOCUMENTS

| | | |
|---|---|---|
| KR | 1005522780000 | 2/2006 |
| KR | 1020080052952 | 6/2008 |

* cited by examiner

*Primary Examiner* — Calvin C Ma
(74) *Attorney, Agent, or Firm* — Innovation Counsel LLP

(57) ABSTRACT

A method of driving a display panel includes respectively outputting first to j-th, where j is a natural number, gate signals to first to j-th gate lines disposed on a first area of the display panel during a load period when an image is displayed on the display panel due to an output of a data signal to the display panel, adjusting a blank gate voltage during a blank period between load periods to generate an adjusted blank gate voltage, generating a blank gate signal based on the adjusted blank gate voltage, and outputting the blank gate signal. Thus, display quality of a display apparatus may be improved.

20 Claims, 7 Drawing Sheets

METHOD OF DRIVING A DISPLAY PANEL, DISPLAY PANEL DRIVING APPARATUS FOR PERFORMING THE METHOD AND DISPLAY APPARATUS HAVING THE DISPLAY PANEL DRIVING APPARATUS

PRIORITY STATEMENT

This application claims priority under 35 U.S.C §119 to Korean Patent Application No. 10-2014-0007854, filed on Jan. 22, 2014 in the Korean Intellectual Property Office (KIPO), the contents of which are herein incorporated by reference in their entireties.

BACKGROUND

1. Field

Exemplary embodiments of the present inventive concept relate to a method of driving a display panel, a display panel driving apparatus for performing the method and display apparatus having the display panel driving apparatus. More particularly, exemplary embodiments of the present inventive concept relate to a method of driving a display panel outputting gate signals to gate lines of the display panel, a display panel driving apparatus for performing the method and display apparatus having the display panel driving apparatus.

2. Description of the Related Art

A display apparatus such as a liquid crystal display apparatus includes a display panel, a gate driving part, a data driving part and a timing controlling part.

The display panel includes gate lines, data lines and pixels. The gate driving part outputs gate signals to the gate lines. The data driving part outputs data signals to the data lines. The timing controlling part outputs gate start signal and a gate clock signal to the gate driving part, and outputs a data start signal and a data clock signal to the data driving part.

First to last gate signals of the gate signals are sequentially applied to the first to last gate lines of the gate lines during a load period of a present frame. A blank period is existed between an output of the last gate signal of the present frame and an output of the first gate signal of a next frame.

The gate driving part outputs blank gate signals during the blank period, and a load of the display panel when the gate driving part outputs the blank gate signals during the blank period is less than a load of the display panel when the gate driving part outputs the gate signals during the load period. Thus, each of levels of the blank gate signals outputted during the blank period is greater than each of levels of the gate signals outputted during the load period. In addition, a level of a gate signal outputted during a load period adjacent to the blank period is increased due to the blank gate signal. Therefore, the levels of the gate signals is not regular, and thus display quality of the display apparatus is decreased.

SUMMARY OF THE INVENTIVE CONCEPT

Exemplary embodiments of the present inventive concept provide a method of driving a display panel capable of improving display quality.

Exemplary embodiments of the present inventive concept also provide a display panel driving apparatus for performing the above-mentioned method.

Exemplary embodiments of the present inventive concept also provide a display apparatus having the above-mentioned display panel driving apparatus.

According to an exemplary embodiment of the present inventive concept, a method of driving a display panel includes respectively outputting first to j-th, where j is a natural number, gate signals to first to j-th gate lines disposed on a first area of the display panel during a load period when an image is displayed on the display panel due to an output of a data signal to the display panel, adjusting a blank gate voltage during a blank period between load periods to generate an adjusted blank gate voltage, generating a blank gate signal based on the adjusted blank gate voltage, and outputting the blank gate signal.

In one embodiment, the generating the adjusted blank gate voltage may include decreasing the blank gate voltage.

In one embodiment, the outputting the first to j-th gate signals may include adjusting a first gate voltage to generate an adjusted first gate voltage, generating a first gate signal based on the adjusted first gate voltage, and outputting the first gate signal to the first gate line disposed on the first area of the display panel.

In one embodiment, the generating the adjusted first gate voltage may include decreasing the first gate voltage.

In one embodiment, the outputting the first to j-th gate signals may include adjusting a j-th gate voltage to generate an adjusted j-th gate voltage, generating the j-th gate signal based on the adjusted j-th gate voltage, and outputting the j-th gate signal to the j-th gate line disposed on the first area of the display panel.

In one embodiment, the generating the adjusted j-th gate voltage may include decreasing the j-th gate voltage.

In one embodiment, the outputting the first to j-th gate signals may include respectively generating second to (j−1)-th gate signals from second to (j−1)-th gate voltage, and respectively outputting the second (j−1)-th gate signals to second to (j−1)-th gate lines disposed on the first area of the display panel.

In one embodiment, the method may further include respectively outputting first to k-th, where k is a natural number, gate signal to first to k-th gate lines disposed on a second area different from the first area of the display panel during the load period.

In one embodiment, the outputting the first to k-th gate signals may include adjusting a first gate voltage to generate an adjusted first gate voltage, generating a first gate signal based on the adjusted first gate voltage, and outputting the first gate signal to the first gate line disposed on the second area of the display panel.

In one embodiment, the generating the adjusted first gate voltage may include decreasing the first gate voltage.

In one embodiment, the outputting the first to k-th gate signals may include adjusting a k-th gate voltage to generate an adjusted k-th gate voltage, generating the k-th gate signal based on the adjusted k-th gate voltage, and outputting the k-th gate signal to the k-th gate line disposed on the second area of the display panel.

In one embodiment, the generating the adjusted k-th gate voltage may include decreasing the k-th gate voltage.

In one embodiment, the outputting the first to k-th gate signals may include respectively generating second to (k−1)-th gate signals from second to (k−1)-th gate voltage, and respectively outputting the second to (k−1)-th gate signals to second to (k−1)-th gate liens disposed on the second area of the display panel.

According to an exemplary embodiment of the present inventive concept, a display panel driving apparatus includes a gate voltage adjusting part, a first gate driving part, a first data driving part and a timing controlling part. The gate voltage adjusting part is configured to adjust a blank gate voltage to generate an adjusted blank gate voltage during a blank period between load periods when an image is displayed on a display panel due to an output of a data signal to the display panel. The first gate driving part is configured to respectively output first to j-th, where j is a natural number, gate signals to first to the j-th gate lines disposed on a first area of the display panel during the load period, and is configured to output a blank gate signal by generating the blank gate signal based on the adjusted blank gate voltage. The first data driving part is configured to output the data signal to a data line disposed on the first area of the display panel. The timing controlling part is configured to output a gate start signal and a gate clock signal to the first gate driving part, and is configured to output a data start signal and a data clock signal to the first data driving part.

In one embodiment, the gate voltage adjusting part may be configured to adjust a first gate voltage to generate an adjusted first gate voltage and may be configured to adjust a j-th gate voltage to generate an adjusted j-th gate voltage, and the first gate driving part may be configured to generate the first gate signal based on the adjusted first gate voltage and may be configured to generate the j-th gate signal based on the adjusted j-th gate voltage.

In one embodiment, the display panel driving apparatus may further include a second gate driving part and the second data driving part. the second gate driving part is configured to respectively output first to k-th, where k is a natural number, gate signals to first to k-th gate lines disposed on a second area different from the first area of the display panel during the load period, and configured to output the blank gate signal by generating the blank gate signal based on the adjusted blank gate voltage. The second data driving part is configured to output the data signal to a data line disposed on the second area of the display panel.

In one embodiment, the gate voltage adjusting part may be configured to adjust a first gate voltage to generate an adjusted first gate voltage and may be configured to adjust a k-th gate voltage to generate an adjusted k-th gate voltage, and the second gate driving part may be configured to generate the first gate signal based on the adjusted first gate voltage and may be configured to generate the k-th gate signal based on the adjusted k-th gate voltage.

According to an exemplary embodiment of the present inventive concept, a display apparatus includes a display panel and a display panel driving apparatus. The display panel is configured to display an image. The display panel driving apparatus includes a gate voltage adjusting part, a first gate driving part, a first data driving part, a second gate driving part, a second data driving part, and a timing controlling part. The gate voltage adjusting part is configured to adjust a blank gate voltage to generate an adjusted blank gate voltage during a blank period between load periods when the image is displayed on the display panel due to an output of a data signal to the display panel. The first gate driving part is configured to respectively output first to j-th, where j is a natural number, gate signals to first to j-th gate lines disposed on a first area of the display panel during the load period and is configured to output a blank gate signal by generating the blank gate signal based on the adjusted blank gate voltage. The first data driving part is configured to output the data signal to a data line disposed on the first area of the display panel. The second gate driving part is configured to respectively output first to k-th, where k is a natural number, gate signals to first to k-th gate lines disposed on a second area different from the first area of the display panel during the load period and is configured to output the blank gate signal by generating the blank gate signal based on the adjusted blank gate voltage. The second data driving part is configured to output the data signal to a data line disposed on the second area of the display panel. The timing controlling part is configured to output a gate start signal and a gate clock signal to the first gate driving part and the second gate driving part and is configured to output a data start signal and a data clock signal to the first data driving part and the second data driving part.

In one embodiment, the first to j-th gate lines may be sequentially disposed toward a boundary between the first area and the second area, and the first to k-th gate lines may be sequentially disposed toward the boundary between the first area an the second area.

In one embodiment, the first to j-th gate lines may be sequentially disposed from an area adjacent to a boundary between the first area and the second area, and the first to k-th gate lines may be sequentially disposed from the area adjacent to the boundary between the first area and the second area.

According to the present inventive concept, data charge rations of pixels in the display panel as well as pixels adjacent to a boundary between a first area and a second area of the display panel may be regular. Thus, display quality of the display apparatus may be improved.

BRIEF DESCRIPTION OF THE DRAWINGS

The above and other features and advantages of the present inventive concept will become more apparent by describing in detailed example embodiments thereof with reference to the accompanying drawings, in which.

DETAILED DESCRIPTION OF THE INVENTIVE CONCEPT

Hereinafter, the present inventive concept will be explained in detail with reference to the accompanying drawings.

Figure 1:
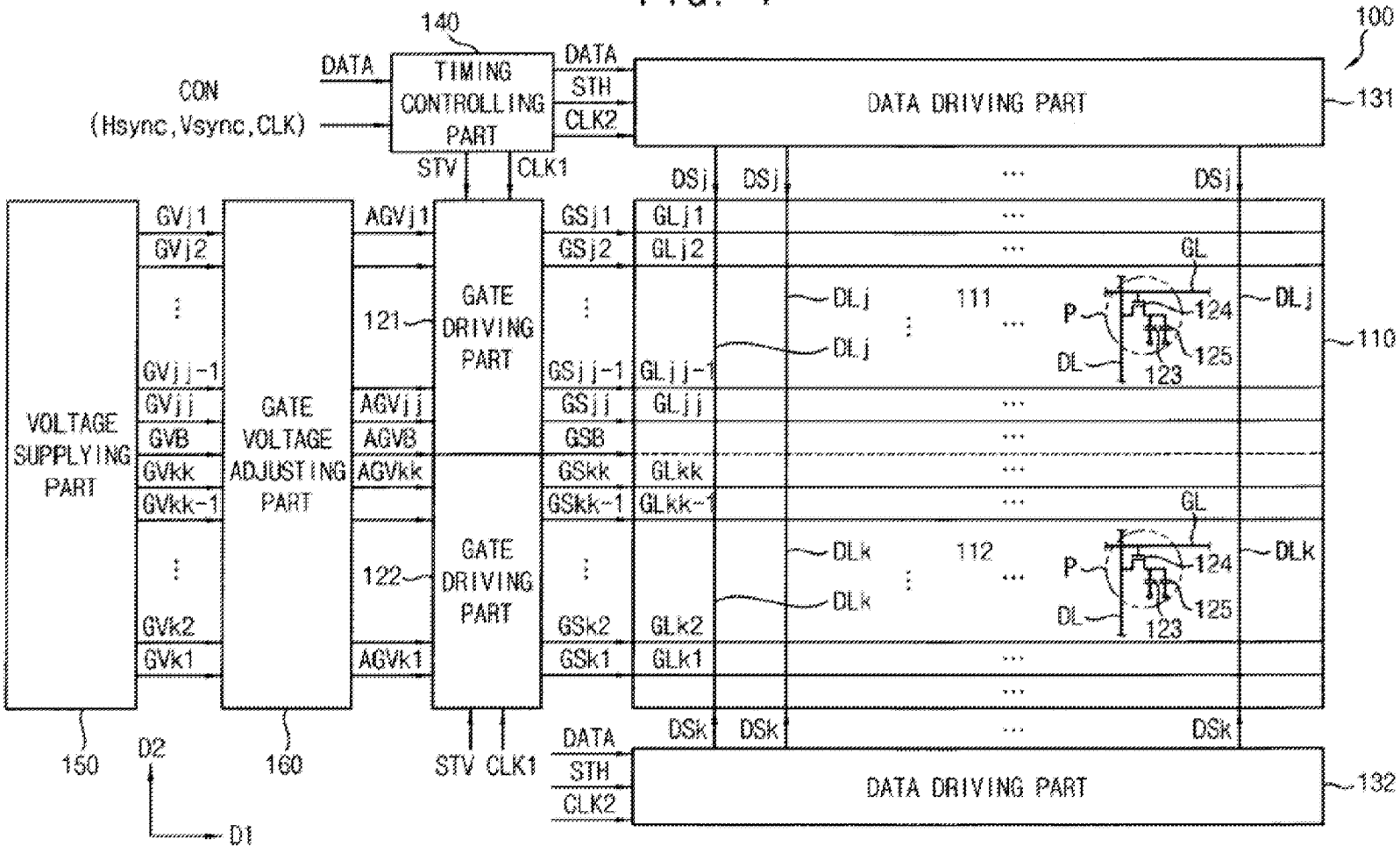
FIG. 1 is a block diagram illustrating a display apparatus according to an exemplary embodiment of the present inventive concept.

FIG. 1 is a block diagram illustrating a display apparatus according to an exemplary embodiment of the present inventive concept.

Referring to FIG. 1, the display apparatus 100 according to the present exemplary embodiment includes a display panel 110, a first gate driving part 121, a second gate driving part 122, a first data driving part 131, a second data driving part 132, a timing controlling part 140, a voltage supplying part 150 and a gate voltage adjusting part 160. The first gate driving part 121, the second gate driving part 122, the first data driving part 131, the second data driving part 132, the timing controlling part 140, the voltage supplying part 150 and the gate voltage adjusting part 160 may be a display panel driving apparatus driving the display panel 110.

The display panel 110 includes a first area 111 and a second area 112.

The first area 111 receives a data signal DSj based on an image data DATA provided from the timing controlling part 140 to display an image. For example, the image data DATA may be two-dimensional plane image data. Alternatively, the image data DATA may include a left-eye image data and a right-eye image data for displaying a three-dimensional stereoscopic image.

The first area 111 includes first, second to (j−1)-th (j is a natural number) and j-th gate lines GLj1, GLj2, . . . , GLjj−1, GLjj, data lines DLj and a plurality of pixels P. The first, second to (j−1)-th and j-th gate lines GLj1, GLj2, . . . , GLjj−1, GLjj extend in a first direction D1. The first, second to (j−1)-th and j-th gate liens GLj1, GLj2, . . . , GLjj−1, GLjj are sequentially disposed toward a boundary between the first area 111 and the second area 112. The data lines DLj extend in a second direction D2 substantially perpendicular to the first direction D1. Each of the pixels P includes a thin film transistor 124 electrically connected to a gate line GL and a data line DL, a liquid crystal capacitor 123 and a storage capacitor 125 connected to the thin film transistor 124. The gate line GL may be one of the first, second to (j−1)-th and j-th gate lines GLj1, GLj2, . . . , GLjj−1, GLjj, and the data line DL may be one of the data lines DLj.

The second area 112 receives a data signal DSk based on the image data DATA provided from the timing controlling part 140 to display the image. The second area 112 includes first, second to (k−1)-th (k is a natural number) and k-th gate lines GLk1, GLk2, . . . , GLkk−1, GLkk, data lines DLk and the pixels P. The first, second to (k−1)-th and k-th gate lines GLk1, GLk2, . . . , GLkk−1, GLkk extend in the first direction D1. The first, second to (k−1)-th and k-th gate lines GLk1, GLk2, . . . , GLkk−1, GLkk are sequentially disposed toward the boundary between the first area 111 and the second area 112. The data lines DLk extend in the second direction D2 substantially perpendicular to the first direction disposed toward the boundary between the first area 111 and the second area 112. The data lines DLk extend in the second direction D2 substantially perpendicular to the first direction D1. Each of the pixels P includes the thin film transistor 124 electrically connected to the gate line GL and the data line DL, the liquid crystal 123 and the storage capacitor 125 connected to the thin film transistor 124. The gate line GL may be one of the first, second (k−1)-th and k-th gate lines GLk1, GLk2, . . . , GLkk−1, GLkk and the data line DL may be one of the data lines DLk.

The number of the first, second to (j−1)-th and j-th gate lines GLj1, GLj2, . . . GLjj−1, GLjj disposed on the first area 111 and the number of the first, second to (k−1)-th and k-th gate lines GLk1, GLk2, . . . GLkk−1, GLkk may be substantially the same.

The first gate driving part 121 generates first, second to (j−1)-th and j-th gate signals GSj1, GSj2, . . . , GSjj−1, GSjj of the first area 111 in response to a gate start signal STV and a gate clock signal CLK1 provided from the timing controlling part 140, and respectively outputs the first, second to (j−1)-th and j-th gate signals GSj1, GSj2, . . . , GSjj−1, GSjj of the first area 111 to the first, second to (j−1)-th and j-th gate lines GLj1, GLj2, . . . , GLjj−1, GLjj disposed on the first area 111. In addition, the first gate driving part 121 may further output a blank gate signal GSB between an output of the j-th gate signal GSjj and an output of the first gate signal GSj1.

The second gate driving part 122 generates first, second to (k−1)-th and k-th gate signals GSk1, GSk2, . . . , GSkk−1, GSkk of the second area 112 in response to the gate start signal STV and the gate clock signal CLK1 provided from the timing controlling part 140, and respectively outputs the first, second to (k−1)-th and k-th gate signals GSk1, GSk2, . . . , GSkk−1, GSkk of the second area 112 to the first, second to (k−1)-th and k-th gate lines GLk1, GLk2, . . . , GLkk−1, GLkk disposed on the second area 112. In addition, the second gate driving part 122 may further output the blank gate signal GSB between an output of the k-th gate signal GSkk and an output of the first gate signal GSk1.

The first data driving part 131 outputs the data signals DSj to the data lines DLj of the first area 111 in response to a data start signal STH and a data clock signal CLK2 provided from the timing controlling part 140.

The second data driving part 132 outputs the data signals DSk to the data lines DLk of the second area 112 in response to the data start signal STH and the data clock signal CLK2 provided form the timing controlling part 140.

The timing controlling part 140 receives the image data DATA and a control signal CON from an outside. The control signal CON may include a horizontal synchronous signal Hsync, a vertical synchronous signal Vsync and a clock signal CLK. The timing controlling part 140 generates the data start signal STH using the horizontal synchronous signal Hsync and outputs the data start signal STH to the first data driving part 131 and the second data driving part 132. In addition, the timing controlling part 140 generates the gate start signal STV using the vertical synchronous signal Vsync and outputs the gate start signal STV to the first gate driving part 121 and the second gate driving part 122. In addition, the timing controlling part 140 generates the gate clock signal CLK1, and the data clock signal CLK2 using the clock signal CLK, outputs the gate clock signal CLK1 to the first gate driving part 121 and the second gate driving part 122, and outputs the data clock signal CLK2 to the first data driving part 131 and the second data driving part 132.

The voltage supplying part 150 outputs first, second to (j−1)-th and j-th gate voltages GVj1, GVj2, . . . , GVjj−1, GVjj of the first area 111. In addition, the voltage supplying part 150 outputs first, second to (k−1)-th and k-th gate voltages GVk1, GVk2, . . . , GVkk−1, GVkk of the second area 112. In addition, the voltage supplying part 150 outputs a blank gate voltage GVB between an output of the j-th gate voltage GVjj of the first area 111 and an output of the first gate voltage GVj1 of the first area 111. In addition, the voltage supplying part 150 outputs the blank gate voltage GVB between an output of the k-th gate voltage GVkk of the second area 112 and an output of the first gate voltage GVk1.

Specifically, the voltage supplying part 150 outputs the first gate voltage GVj1 of the first area 111, the j-th gate voltage GVjj of the first area 111, the first gate voltage GVk1 of the second area 112, the k-th gate voltage GVkk of the second area 112 and the blank gate voltage GVB to the gate voltage adjusting part 160. In addition, the voltage supplying part 150 outputs the second to (j−1)-th gate voltages GVj2, . . . , GVjj−1 of the first area 111 to the first gate driving part 121, and outputs the second to (k−1)-th gate voltages GVk2, . . . , GVkk−1 of the second area 112 to the second gate driving part 122.

The gate voltage adjusting part 160 receives the first gate voltage GVj1 and the j-th gate voltage GVjj of the first area 111 from the voltage supplying part 150, and adjusts the first gate voltage GVj1 and the j-th gate voltage GVjj of the first area 111 to respectively output an adjusted first gate voltage AGVj1 and an adjusted j-th gate voltage AGVjj of the first area 111. Specifically, the gate voltage adjusting part 160 decreases the first gate voltage GVj1 and the j-th gate voltage GVjj of the first area 111 to respectively generate the adjusted first gate voltage AGVj1 and the adjusted j-th gate voltage AGVjj of the first area 111, and outputs the adjusted first gate voltage AGVj1 and the adjusted j-th gate voltage AGVjj of the first area 111.

In addition, the gate voltage adjusting part 160 receives the first gate voltage GVk1 and the k-th gate voltage GVkk of the second area 112 from the voltage supplying part 150, and adjusts the first gate voltage GVk1 and the k-th gate voltage GVkk of the second area 112 to respectively output an adjusted first gate voltage AGVk1 and an adjusted k-th gate voltage AGVkk of the second area 112. Specifically, the gate voltage adjusting part 160 decreases the first gate voltage GVk1 and the k-th gate voltage GVkk of the second area 112 to respectively generate the adjusted first gate voltage AGVk1 and the adjusted k-th gate voltage AGVkk of the second area 112, and outputs the adjusted first gate voltage AGVk1 and the adjusted k-th gate voltage AGVkk of the second area 112.

In addition, the gate voltage adjusting part 160 receives the blank gate voltage GVB from the voltage supplying part 150, and adjusts the blank gate voltage GVB to output an adjusted blank gate voltage AGVB. Specifically, the gate voltage adjusting part 160 decreases the blank gate voltage GVB to output the adjusted blank gate voltage AGVB, and a outputs the adjusted blank gate voltage AGVB.

The first gate driving part 121 outputs the first gate signal GSj1 of the first area 111 based on the adjusted first gate voltage AGVj1 of the first area 111, respectively outputs the secon(j1)-th gate voltages GVj2, . . . , GVjj−1 of the first area 111, outputs the j-th gate d to (j−1)-th gate signals GSj2, . . . , GSjj−1 of the first area 111 based on the second to signal GSjj of the first area 111 based on the adjusted j-th gate voltage AGVjj of the first area 111, and outputs the blank gate signal GSB based on the adjusted blank gate voltage AGVB.

The second gate driving part 122 outputs the first gate signal GSk1 of the second area 112 based on the adjusted first gate voltage AGVk1 of the second area 112, respectively outputs the second to (k−1)-th gate signals GSk2, . . . , GSkk−1 of the second area 112 based on the second to (k−1)-th gate voltages GVk2, . . . , GVkk−1 of the second area 112, outputs the k-th gate signal GSkk of the second area 112 based on the adjusted k-th gate voltage AGVkk of the second area 112, and outputs the blank gate signal GSB based on the adjusted blank gate voltage AGVB.

Figure 2A:
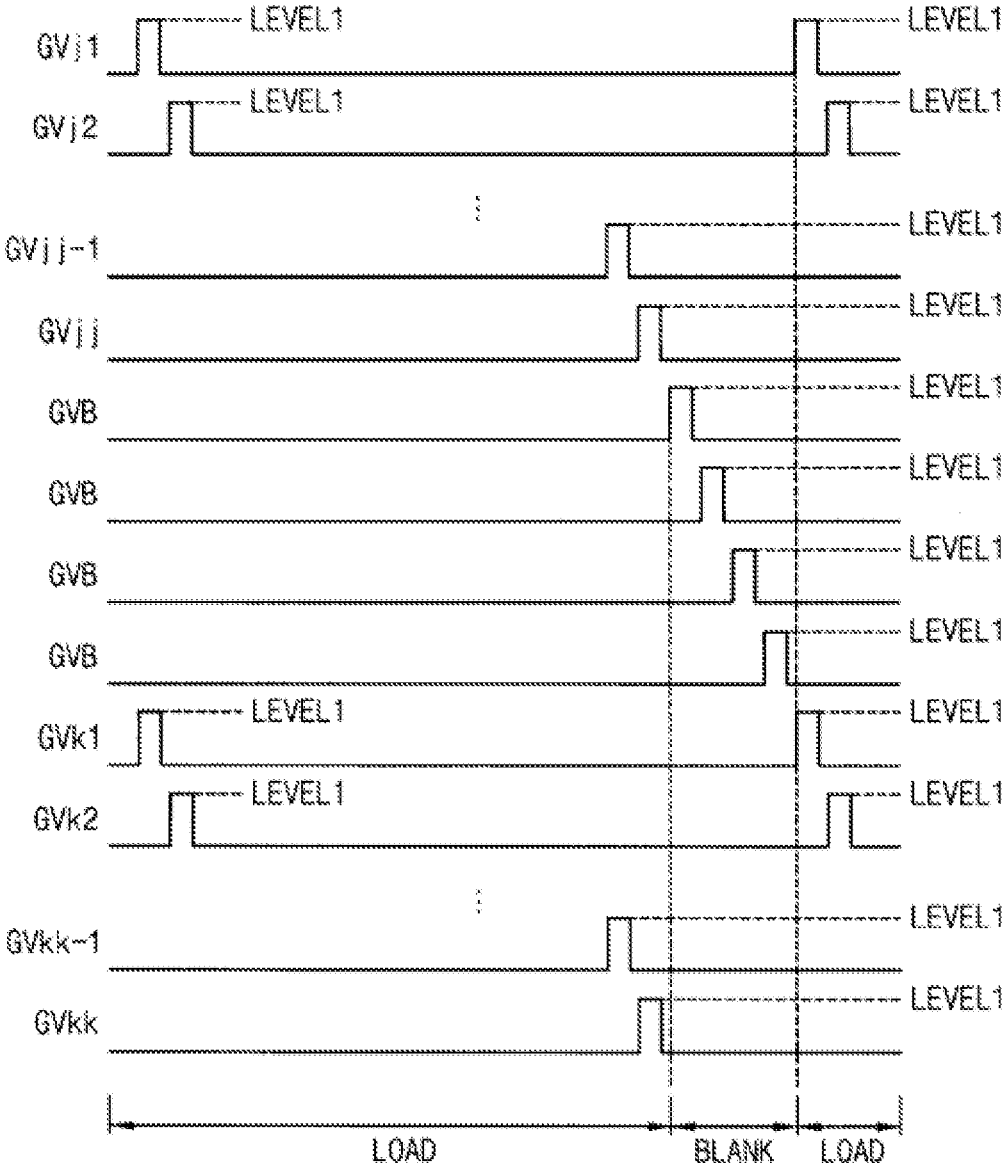
FIG. 2A is a waveforms diagram illustrating first, second to (j−1)-th and j-th gate voltages of a first area, first, second to (k−1)-th and k-th gate voltages of a second area and a blank gate voltage of FIG. 1.

FIG. 2A is waveforms diagram illustrating the first, second to (j−1)-th and j-th gate voltages GVj1, GVj2, . . . , GVjj−1, GVjj of the first area 111, the first, second to (k−1)-th and k-th gate voltages GVk1, GVk2, . . . , GVkk−1, GVkk of the second area 112 and the blank gate voltage GVB of FIG. 1.

Referring to FIGS. 1 to 2A, the first, second to (j−1)-th and j-th gate voltages GVj1, GVj2, . . . , GVjj−1, GVjj of the first area 111 are sequentially activated and the first, second to (k−1)-th and k-th gate voltages GVk1, GVk2, . . . , GVkk−1, GVkk of the second area 12 are sequentially activated during a load period LOAD. The load period LOAD may be defined as a period when the data signals DSj and DSk are applied to the display panel 110 and the image is displayed on the display panel 110. The first, second to (j−1)-th and j-th gate voltages GVj1, GVj2, . . . , GVjj−1, GVjj of the first area 111 and the first, second to (k−1)-th and k-th gate voltages GVk1, GVk2, . . . , GVkk−1, GVkk of the second area 112 may be activated substantially at the same time.

The blank gate voltages GVB are activated during a blank period BLANK next to the load period LOAD. The blank period BLANK is disposed between the load periods LOAD.

Each of the levels of the first, second to (j−1)-th and j-th gate voltages GVj1, GVj2, . . . , GVjj−1, GVjj of the first area 111, each of the first, second to (k−1)-th and k-th gate voltages GVk1, GVk2, . . . , GVkk−1, GVkk of the second area 112 and each of the levels of the blank gate voltages GVB may be substantially the same as a first level LEVEL1.

Figure 2B:
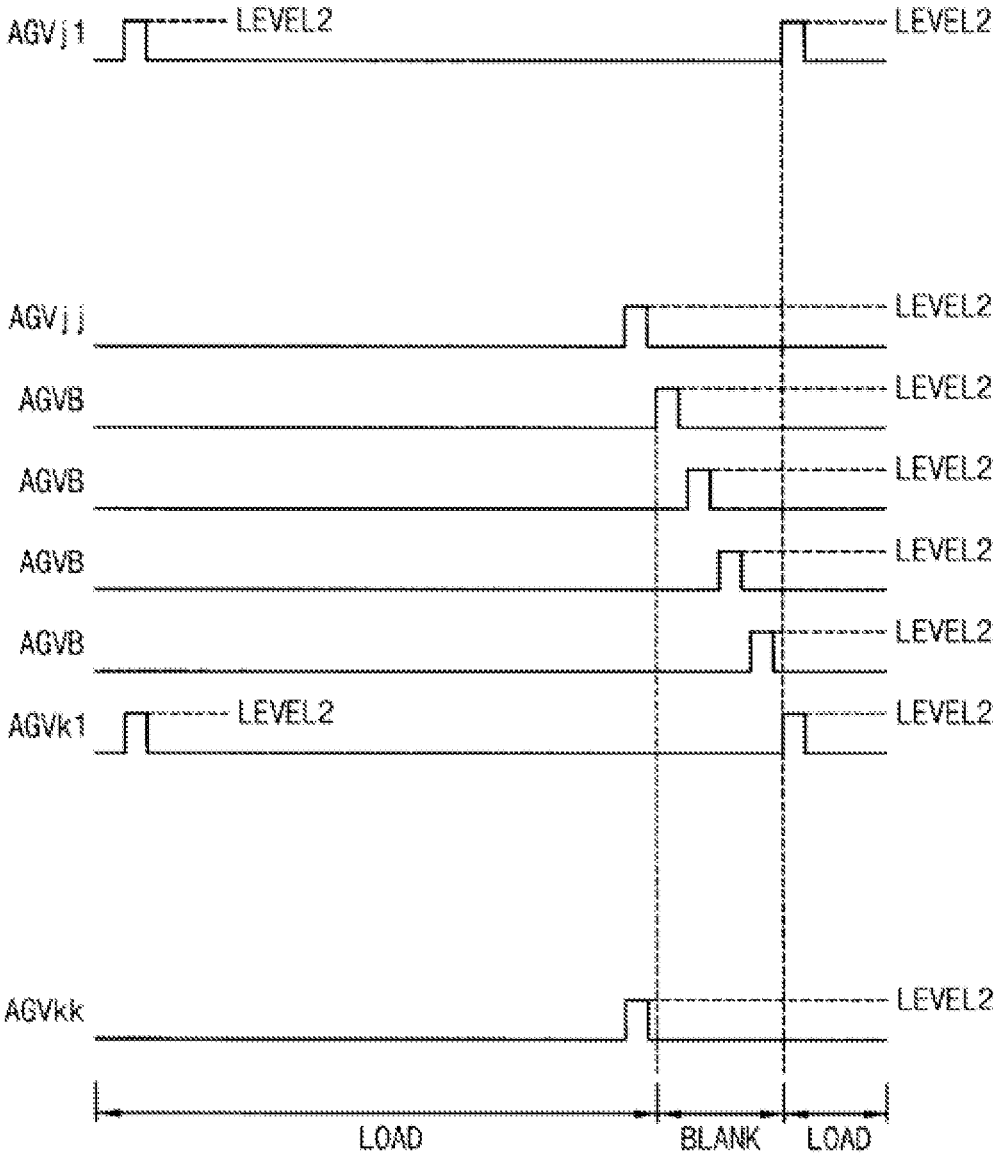
FIG. 2B is waveforms diagram illustrating an adjusted first gate voltage of a first area, an adjusted j-th gate voltage of the first area, an adjusted first gate voltage of a second area, an adjusted k-th gate voltage of the second area and the adjusted blank gate voltage of FIG. 1.

FIG. 2B is waveforms diagram illustrating the adjusted first gate voltage AGVj1 of the first area 111, the adjusted j-th gate voltage AGVjj of the first area 111, the adjusted first gate voltage AGVk1 of the second area 112, the adjusted k-th gate voltage AGVkk of the second area 112 and the adjusted blank gate voltage AGVB of FIG. 1.

Referring to FIGS. 1 to 2B, each of levels of the adjusted first gate voltage AGVj1 of the first area 111, the adjusted j-th gate voltage AGVjj of the first area 111, the adjusted first gate voltage AGVk1 of the second area 112, the adjusted k-th gate voltage AGVkk of the second area 112 and the adjusted blank gate voltage AGVB may be substantially the same as a second level LEVEL2 less than the first level LEVEL1.

Figure 2C:
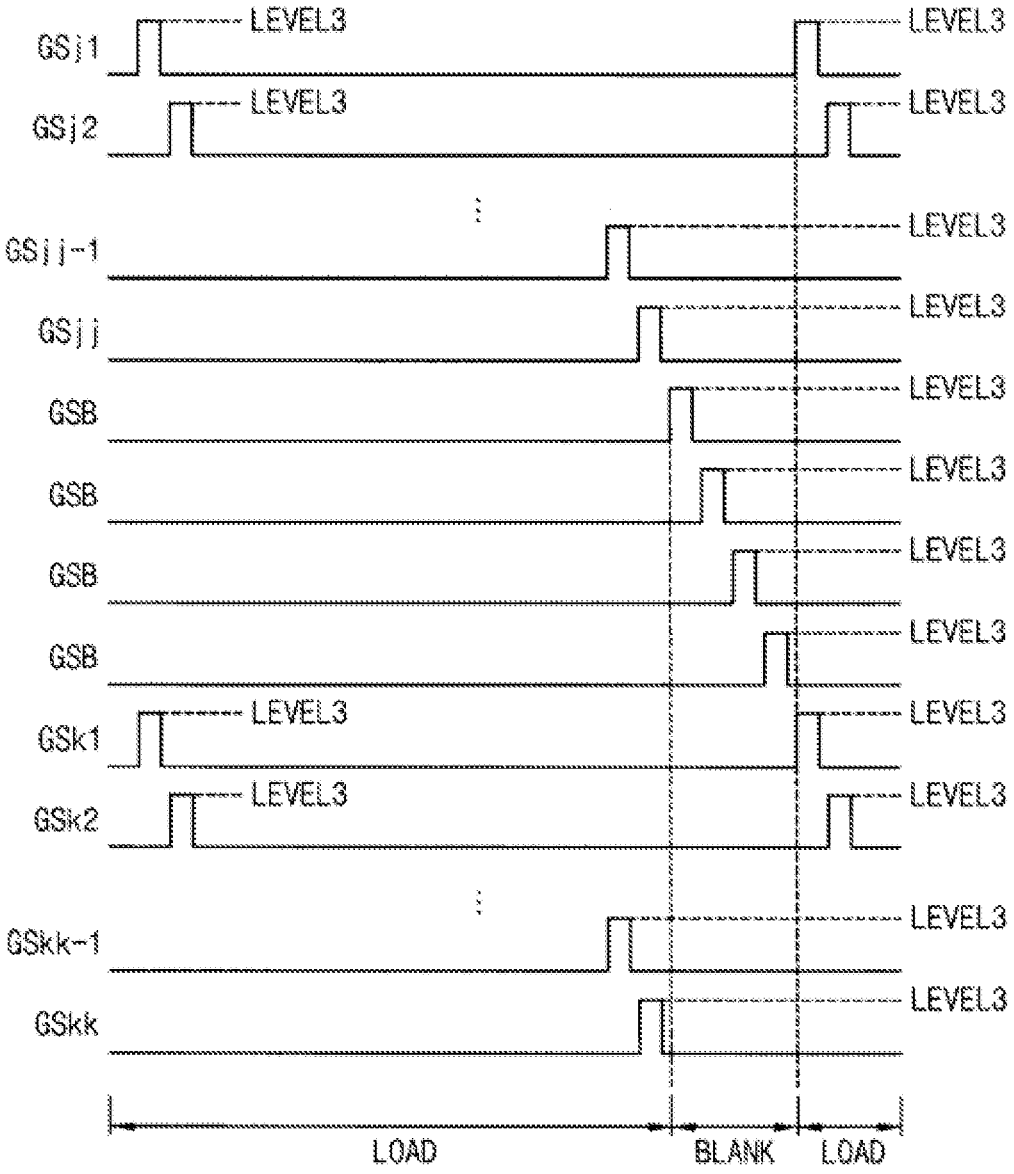
FIG. 2C is a waveforms diagram illustrating first, second to (j−1)-th and j-th gate signals of the first area, first, second to (k−1)-th and k-th gate signals of the second area and a blank gate signals of FIG. 1.

FIG. 2C is a waveforms diagram illustrating the first, second to (j−1)-th and j-th gate signals GSj1, GSj2, . . . , GSjj−1, GSjj of the first area 111, the first, second to (k−1)-th and k-th gate signals GSk1, GSk2, . . . , GSkk−1 and GSkk of the second area 112 and the blank gate signals GSB of FIG. 1.

Referring to FIGS. 1 to 2C, the first, second to (j−1)-th and j-th gate signals GSj1, GSj2, . . . ., GSjj−1, GSjj of the first area 111 are sequentially activated and the first, second to (k−1)-th and k-th gate signals GSk1, GSk2, . . . , GSkk−1 and GSkk of the second area 12 are sequentially activated during the load period LOAD. The first, second to (j−1)-th and j-th gate signals GSj1, GSj2, . . . , GSjj−1, GSjj of the first area 111 and the first, second to (k−1)-th and k-th gate signals GSk1, GSk2, . . . , GSkk−1 and GSkk of the second area 112 may be activated substantially at the same time.

The blank gate signal GSB is activated during the blank period BLANK next to the load period LOAD.

Each of levels of the first, second to (j−1)-th and j-th gate signals GSj1, GSj2, . . . , GSjj−1, GSjj of the first area 111, the first, second to (k−1)-th and k-th gate signals GSk1, GSk2, . . . , GSkk−1 and GSkk of the second area 112 and the blank gate signals GSB may be substantially the same as a third level LEVEL3. The third level LEVEL3 may be substantially the same as the first level LEVEL1, and the third level LEVEL3 may be greater than the second level LEVEL2.

Figure 3A:
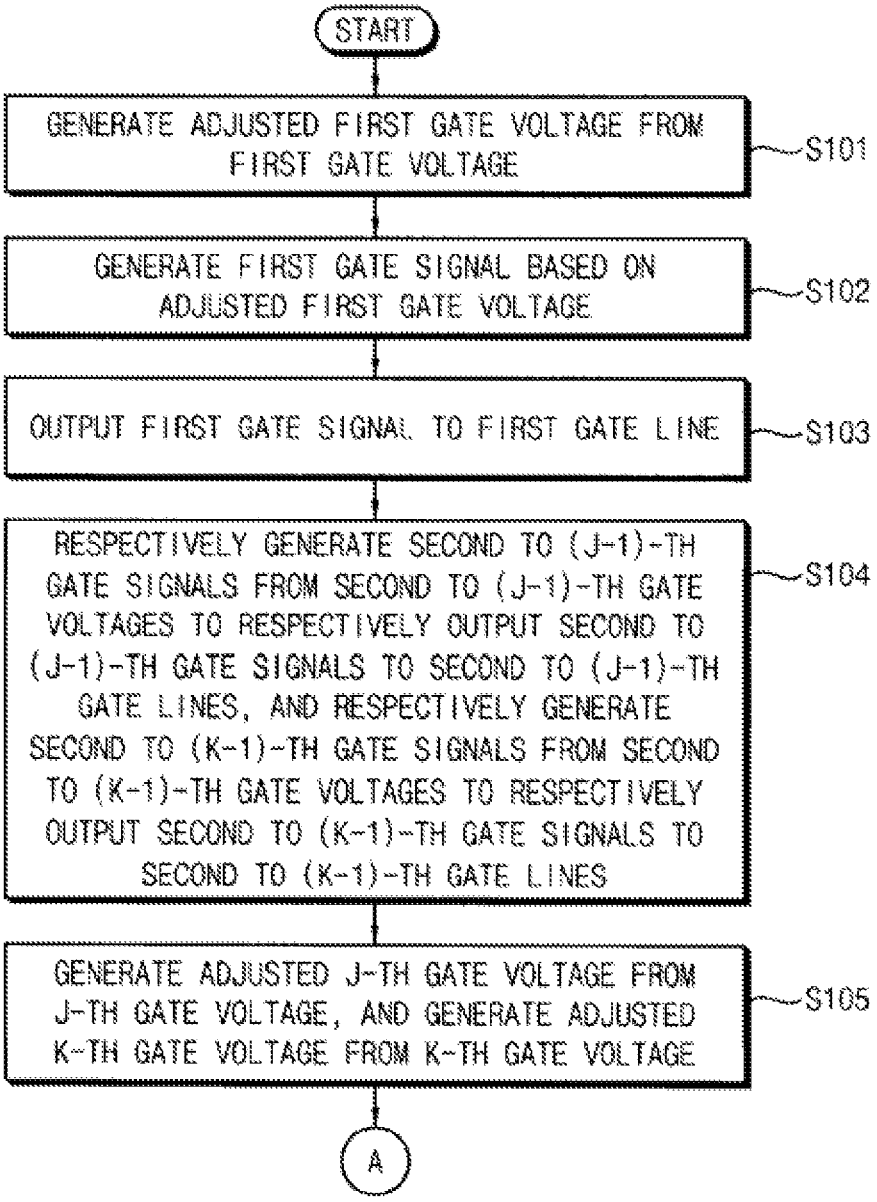
FIGS. 3A and 3B are flow charts illustrating a method of driving a display panel performed by a display panel driving apparatus of FIG. 1.
Figure 3B:
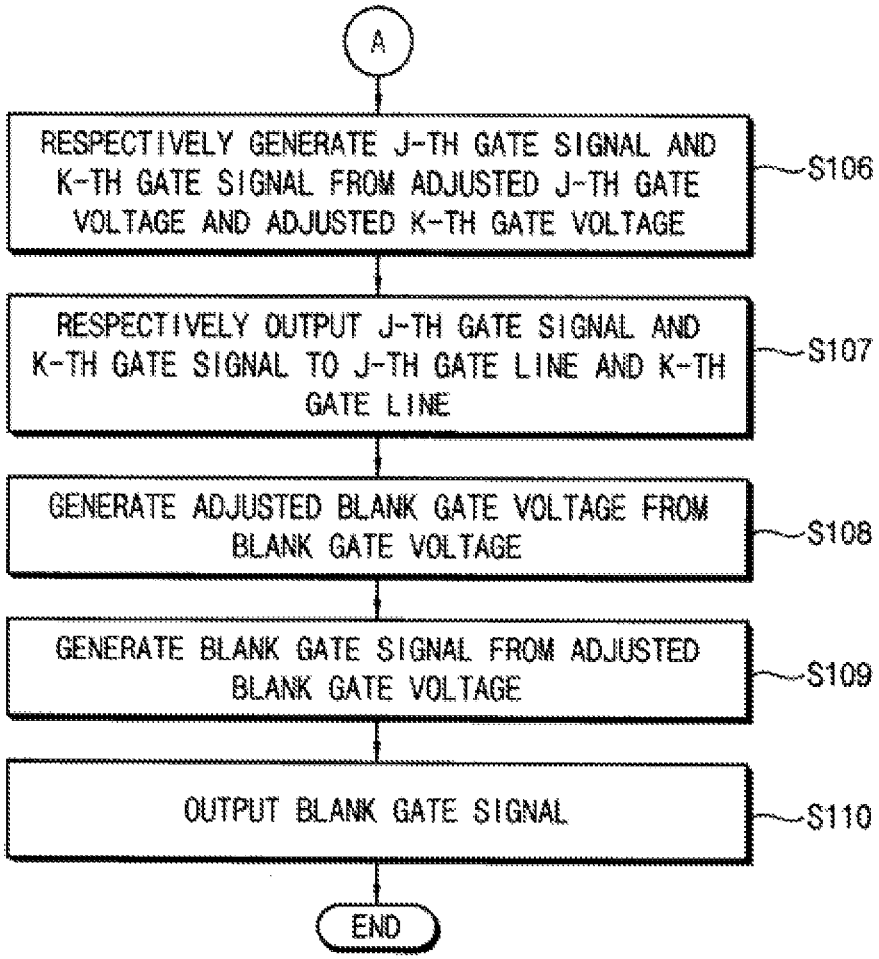

FIGS. 3A and 3B are flow charts illustrating a method of driving a display panel performed by the display panel driving apparatus of FIG. 1.

Referring to FIGS. 1 to 3B, an adjusted first gate voltage is generated from a first gate voltage (operation S101). Specifically, the voltage supplying part 150 outputs the first gate voltage GVj1 of the first area 111 and the first gate voltage GVk1 of the second area 112. The gate voltage adjusting part 160 decreases the first gate voltage GVj1 of the first area 111 and the first gate voltage GVk1 of the second area 112 to respectively generate the adjusted first gate voltage AGVj1 of the first area 111 and the adjusted first gate voltage AGVk1 of the second area 112.

A first gate signal is generated based on the adjusted first gate voltage (operation S102). Specifically, the first gate driving part 121 generates the first gate signal GSj1 of the first area 111 based on the adjusted first gate voltage AGVj1 of the first area 111. The second gate driving part 122 generates the first gate signal GSk1 of the second area 112 based on the adjusted first gate voltage AGVk1 of the second area 112.

The first gate signal is outputted to a first gate line (operation S103). Specifically, the first gate driving part 121 outputs the first gate signal GSj1 of the first area 111 to the first gate line GLj1 of the first area 111. The second gate driving part 122 outputs the first gate signal GSk1 of the second area 112 to the first gate line GLk1 of the second area 112.

The second to (j−1)-th gate signals GSj2, . . . , GSjj−1 are respectively generated from the second to (j−1)-th gate voltages GVj2, . . . , GVjj−1 and the second to (j−1)-th gate signals GSj2, . . . , GSjj−1 are respectively outputted to the second to (j−1)-th gate lines GLj2, . . . , GLjj−1, and the second to (k−1)-th gate signals GSk2, . . . , GSkk−1 are respectively generated from the second to (k−1)-th gate voltages GVk2, . . . , GVkk−1 and the second to (k−1)-th gate signals GSk2, . . . , GSkk−1 are respectively outputted to the second to (k−1)-th gate lines GLk2, . . . , GLkk−1 (operation S104). Specifically, the first gate driving part 121 respectively generates the second to (j−1)-th gate signals GSj2, . . . , GSjj−1 of the first area 111 based on the second to (j−1)-th gate voltages GVj2, . . . , GVjj−1 of the first area 111 provided from the voltage supplying part 150, and respectively outputs the second to (j−1)-th gate signals GSj2, . . . , GSjj−1 of the first area 111 to the second to (j−1)-th gate lines GLj2, . . . , GLjj−1 of the first area 111. The second gate driving part 122 respectively generates the second to (k−1)-th gate signals GSk2, . . . , GSkk−1 of the second area 112 based on the second to (k−1)-th gate voltages GVk2, . . . , GVkk−1 of the second area 112 provided from the voltage supplying part 150, and respectively outputs the second to (k−1)-th gate signals GSk2, . . . , GSkk−1 of the second area 112 to the second to (k−1)-th gate liens GLk2, . . . , GLkk−1 of the second area 112.

The adjusted j-th gate voltage AGVjj is generated from the j-th gate voltage GVjj, and the adjusted k-th gate voltage AGVkk is generated from the k-th gate voltage GVkk (operation S105). Specifically, the voltage supplying part 150 generates the j-th gate voltage GVjj of the first area 111. In addition, the voltage supplying part 150 generates the k-th gate voltage GVkk of the second area 112. The gate voltage adjusting part 160 decreases the j-th gate voltage GVjj of the first area 111 to generate the adjusted j-th gate voltage AGVjj of the first area 111. In addition, the gate voltage adjusting part 160 decreases the k-th gate voltage GVkk of the second area 112 to generate the adjusted k-th gate voltage AGVkk of the second area 112.

The j-th gate signal GSjj and the k-th gate signal GSkk are respectively generated from the adjusted j-th gate voltage AGVjj and the adjusted k-th gate voltage AGVkk (operation S106). Specifically, the first gate driving part 121 generates the j-th gate signal GSjj of the first area 111 based on the adjusted j-th gate voltage AGVjj of the first area 111. The second gate driving part 122 generates the k-th gate signal GSkk of the second area 112 based on the adjusted k-th gate voltage AGVkk of the second area 112.

The j-th gate signal GSjj and the k-th gate signal GSkk are respectively outputted to the j-th gate line GLjj and the k-th gate line GLkk (operation S107). Specifically, the first gate driving part 121 outputs the j-th gate signal GSjj of the first area 111 to the j-th gate line GLjj of the first area 111. The second gate driving part 122 outputs the k-th gate signal GSkk of the second area 112 to the k-th gate line GLkk of the second area 112.

The adjusted blank gate voltage AGVB is generated from the blank gate voltage GVB (operation S108). Specifically, the voltage supplying part 150 outputs the blank gate voltage GVB. The gate voltage adjusting part 160 decreases the blank gate voltage GVB to generate the adjusted blank gate voltage AGVB.

The blank gate signal GSB is generated from the adjusted blank gate voltage AGVB (operation S109). Specifically, the first gate driving part 121 generates the blank gate signal GSB based on the adjusted blank gate voltage AGVB. The second gate driving part 122 generate the blank gate signal GSB based on the adjusted blank gate voltage AGVB.

The blank gate signal GSB is outputted (operation S110). Specifically, the first gate driving part 121 outputs the blank gate signal GSB during the blank period BLANK between the load periods LOAD. The second gate driving part 122 outputs the blank gate signal GSB during the blank period BLANK between the load periods LOAD.

A load of the display panel 110 when each of the first, second to (j−1)-th and j-th gate signals GSj1, GSj2, . . . , GSjj−1, GSjj of the first area 111 is applied to the display panel 110 is greater than a load of the display panel 110 when the blank gate signal GSB is applied to the display panel 110. Therefore, when the first gate driving part 121 directly receives the blank gate voltage GVB from the voltage supplying part 150 and outputs the blank gate signal GSB based on the blank gate voltage GVB, a level of the blank gate signal GSB may be greater than each of the levels of the first, second to (j−1)-th gate signals GSj1, GSj2, . . . , GSjj−1, GSjj of the first area 111.

In addition, when the level of the blank gate signal GSB is greater than each of the levels of the first, second to (j−1)-th and j-th gate signals GSj1, GSj2, . . . , GSjj−1, GSjj of the first area 111, each of the level of the first gate signal GSj1 of the first area 111 and the level of the j-th gate signal GSjj of the first area 111 outputted during the load period LOAD adjacent to the blank period BLANK may be greater than each of the levels of the second to (j−1)-th gate signals GSj2, . . . , GSjj−1 of the first area 111.

In addition, a load of the display panel 110 when each of the first, second to (k−1)-th and k-th gate signals GSk1, GSk2, . . . , GSkk−1, GSkk of the second area 112 is applied to the display panel 110 is greater than the load of the display panel 110 when the blank gate signal GSB is applied to the display panel 110. Therefore, when the second gate driving part 122 directly receives the blank gate voltage GVB from the voltage supplying part 150 and outputs the blank gate signal GSB based on the blank gate voltage GVB, the level of the blank gate signal GSB may be greater than each of the levels of the first, second to (k−1)-th and k-th gate signals GSk1, GSk2, . . . , GSkk−1, GSkk of the second area 112.

In addition, when the level of the blank gate signal GSB is greater than each of the levels of the first, second to (k−1)-th and k-th gate signals GSk1, GSk2, . . . , GSkk−1, GSkk of the second area 112, each of the level of the first gate signal GSk1 of the second area 112 and the level of the k-th gate signal GSkk of the second area 111 outputted during the load period LOAD adjacent to the blank period BLANK may be greater than each of the levels of the second to (k−1)-th gate signals GSk2, . . . , GSkk−1 of the second area 112.

However, in the present exemplary embodiment, the gate voltage adjusting part 160 decreases the blank gate voltage GVB to generate the adjusted blank gate voltage AGVB, and the first driving part 121 outputs the blank gate signal GSB based on the adjusted blank gate voltage AGVB, therefore the level of the blank gate signal GSB may be substantially the same as each of the levels of the first, second to (j−1)-th and j-th gate signals GSj1, GSj2, . . ., GSjj−1, GSjj of the first area 111.

In addition, the gate voltage adjusting part 160 decreases the first gate voltage GVj1 and the j-th gate voltage GVjj of the first area 111 to respectively generate the adjusted first gate voltage AGVj1 and the adjusted j-th gate voltage AGVjj of the first area 111, and the first gate driving part 121 respectively outputs the first gate signal GSj1 and the j-th gate signal GSjj of the first area 111 based on the adjusted first gate voltage AGVj1 and the adjusted j-th gate voltage AGVjj of the first area 111. Therefore each of the level of the first gate signal GSj1 of the first area 111 and the level of the j-th gate signal GSjj of the first are a 111 may be substantially the same as each of the levels of the second to (j−1)-th gate signals GSj2, . . . , GSjj−1 of the first area 111.

In addition, the gate voltage adjusting part 160 decreases the blank gate voltage GVB to generate the adjusted blank gate voltage AGVB, and the second gate driving part 122 outputs the blank gate signal GSB based on the adjusted blank gate voltage AGVB. Therefore the level of the blank gate signal GSB may be substantially the same as each of the levels of the first, second to (k−1)-th and k-th gate signals GSk1, GSk2, . . . , GSkk−1, GSkk of the second area 112.

In addition, the gate voltage adjusting part 160 decrease the first gate voltage GVk1 and the k-th gate voltage GVkk of the second area 112 to respectively generate the adjusted first gate voltage AGVk1 and the adjusted k-th gate voltage AGVkk of the second area 112, and the second gate driving part 122 respectively outputs the first gate signal GSk1 and the k-th gate signal GSkk of the second area 112 based on the adjusted first gate voltage AGVk1 and the adjusted k-th gate voltage AGVkk of the second area 112. Therefore each of the level of the first gate signal GSk1 of the second area 112 and the level of the k-th gate signal GSkk of the second area 112 may be substantially the same as each of the levels of the second to (k−1)-th gate signals GSk2, . . . , GSkk−1 of the second area 112.

According to the present exemplary embodiment, the gate voltage adjusting part 160 decreases the blank gate voltage GVB outputted during the blank period BLANK. In addition, the gate voltage adjusting part 160 decreases the first gate voltage GVj1 and the j-th gate voltage GVjj of the first area 111 outputted during the load period LOAD adjacent to the blank period BLANK. In addition, the gate voltage adjusting part 160 decreases the first gate voltage GVk1 and the k-th gate voltage GVkk of the second area 112 outputted during the load period LOAD adjacent to the blank period BLANK. Therefore, each of the levels of the first, second to (j−1)-th and j-th gate signals GSj1, GSj2, . . . , GSjj of the first area 111 applied to the display panel 110 during the load period LOAD, each of the levels of the first, second to (k−1)-th and k-th gate signals GSk1, GSk2, . . . , GSkk−1, GSkk of the second area 112 applied to the display panel 110 during the load period LOAD, and the level of the blank gate signal GSB outputted during the blank period BLANK may be substantially the same. Thus, data charge rations of the pixels P in the display panel 110 as well as the pixels P adjacent to the boundary between the first area 111 and the second area 112 may be regular.

Figure 4:
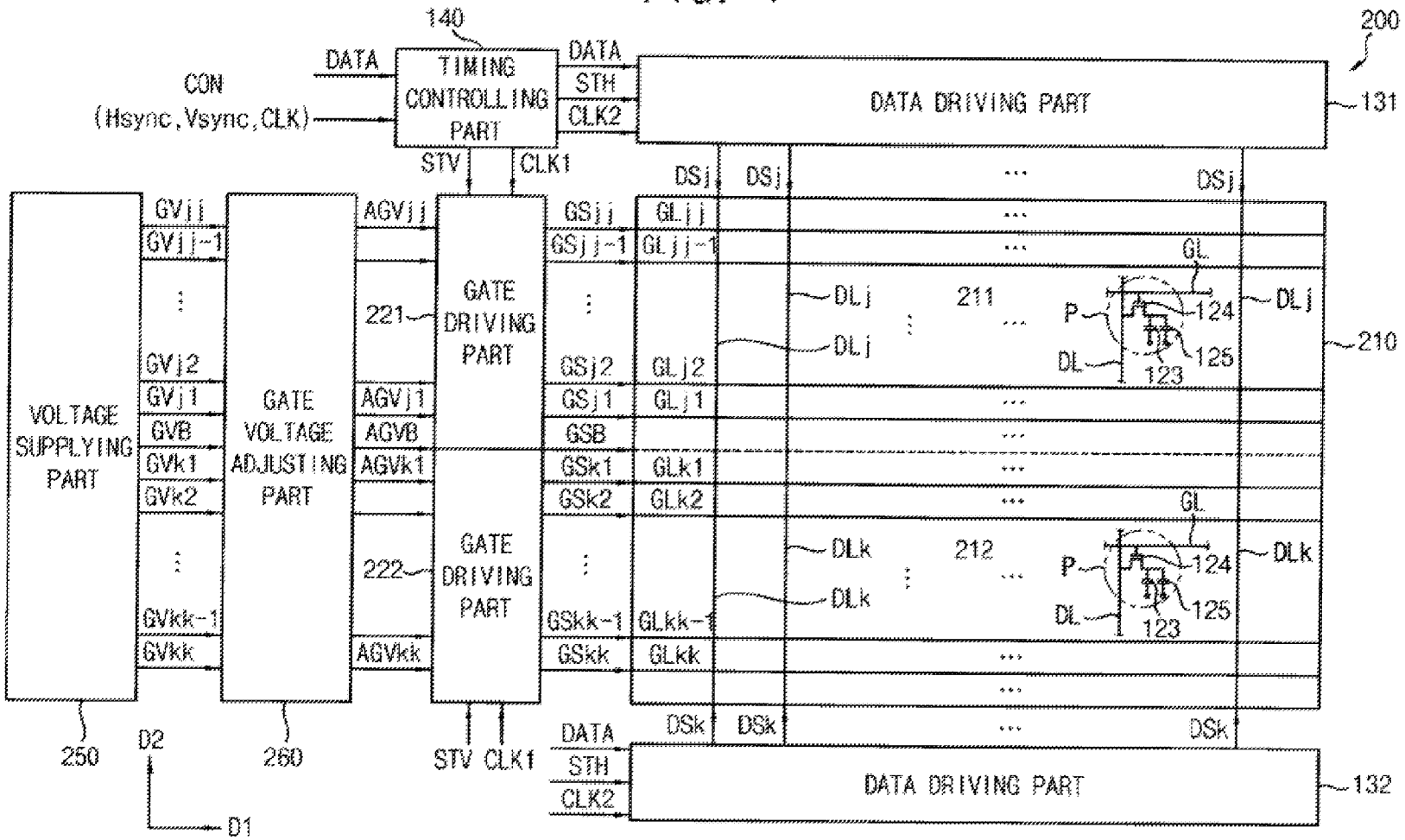
FIG. 4 is a block diagram illustrating an exemplary embodiment.

FIG. 4 is a block diagram illustrating an exemplary embodiment.

The display apparatus 200 according to the present exemplary embodiment is substantially the same as the display apparatus 100 according to the previous exemplary embodiment illustrated in FIG. 1 except for a display panel 210, a first gate driving part 221, a second gate driving part 222, a voltage supplying part 250 and a gate voltage adjusting part 260. Thus, the same reference numerals will be used to refer to same or like parts as those described in the previous exemplary embodiment and any further repetitive explanation concerning the above elements will be omitted.

Referring to FIG. 4, the display apparatus 200 according to the present exemplary embodiment includes the display panel 210, the first gate driving part 221, the second gate driving part 222, the first data driving part 131, the second data driving part 132, the timing controlling part 140, the voltage supplying part 250 and the gate voltage adjusting part 260. The first gate driving part 221, the second gate driving part 222, the first data driving part 131, the second data driving part 132, the timing controlling part 140, the voltage supplying part 250 and the gate voltage adjusting part 260 may be a display panel driving apparatus driving the display panel 210.

The display panel 210 includes a first area 211 and a second area 212.

The first area 211 receives the data signal DSj based on the image data DATA provided from the timing controlling part 140 to display the image.

The first area 211 includes the first, second to (j−1)-th (j is a natural number) and j-th gate lines GLj1, GLj2, . . . , GLjj−1, GLjj, the data lines DLj and the pixels P. The first, second to (j−1)-th and j-th gate lines GLj1, GLj2, . . . , GLjj−1, GLjj extend in the first direction D1. The first, second to (j−1)-th and j-th gate lines GLj1, GLj2, . . . , GLjj−1, GLjj are sequentially disposed from an area adjacent to a boundary between the first area 211 and the second area 212. The data lines DLj extend in the second direction D2 substantially perpendicular to the first direction D1. Each of the pixels P includes the thin film transistor 124 electrically connected to the gate line GL and the data line DL, the liquid crystal capacitor 123 and the storage capacitor 125 connected to the thin film transistor 124. The gate line GL may be one of the first, second to (j−1)-th and j-th lines GLj1, GLj2, . . . , GLjj−1, GLjj, and the data line DL may be one of the data lines DLj.

The second area 212 receives the data signal DSk based on the image data DATA provided from the timing controlling part 140 to display the image. The second area 212 includes the first, second to (k−1)-th (k is a natural number) and k-th gate lines GLk1, GLk2, . . . , GLkk−1, GLkk, data lines DLk and the pixels P. The first, second to (k−1)-th and k-th gate lines GLk1, GLk2, . . . , GLkk−1, GLkk extend in the first direction D1. The first, second to (k−1)-th and k-th gate lines GLk1, GLk2, . . . , GLkk−1, GLkk are sequentially disposed from the area adjacent to the boundary between the first area 211 and the second area 212. The data lines DLk extend in the second direction D2 substantially perpendicular to the first direction D1. Each of the pixels P includes the thin film transistor 124 electrically connected to the gate line GL and the data line DL, the liquid crystal capacitor 123 and the storage capacitor 125 connected to the thin film transistor 124. The gate line GL may be one of the first, second to (k−1)-th and k-th gate liens GLk1, GLk2, . . . , GLkk−1, GLkk, and the data line DL may be one of the data lines DLk.

The number of the first, second to (j−1)-th and j-th lines GLj1, GLj2, . . . , GLjj−1, GLjj disposed on the first area 211 and the number of the first, second to (k−1)-th and k-th gate lines GLk1, GLk2, . . . , GLkk−1, GLkk may be substantially the same.

The first driving part 221 generates the first, second to (j−1)-th and j-th gate signals GSj1, GSj2, . . . , GSjj−1, GSjj of the first area 211 in response to the gate start signal STV and the gate clock signal CLK1 provided from the timing controlling part 140, and respectively outputs the first, second to (j−1)-th and j-th gate signals GSj1, GSj2, . . . , GSjj−1, GSjj of the first area 211 to the first, second to (j−1)-th and j-th gate lines GLj1, GLj2, . . . , GLjj−1, GLjj disposed on the first area 211. In addition, the first gate driving part 221 may further outputs the blank gate signal GSB between the output of the j-th gate signal GSjj and the output of the first gate signal GSj1.

The second gate driving part 222 generates the first, second to (k−1)-th and k-th gate signals GSk1, GSk2, . . ., GSkk−1, GSkk of the second area 212 in response to the gate start signal STV and the gate clock signal CLK1 provided from the timing controlling part 140, and respectively outputs the first, second to (k−1)-th and k-th gate lines GSk1, GSk2, . . . , GSkk−1, GSkk of the second area 212 to the first, second to (k−1)-th and k-th gate lines GLk1, GLk2, . . ., GLkk−1, GLkk disposed on the second area 212. In addition, the second ate driving part 222 may further output the blank signal GSB between the output of the k-th gate signal GSkk and the output of the first gate signal GSk1.

The voltage supplying part 250 outputs the first, second to (j−1)-th and j-th gate voltages GVj1, GVj2, . . . , GVjj−1, GVjj of the first area 211. In addition, the voltage supplying part 250 outputs the first, second to (k−1)-th and k-th gate voltages GVk1, GVk2, . . . , GVkk−1, GVkk of the second area 212. In addition, the voltage supplying part 250 outputs the blank gate voltage GVB between the output of the j-th gate voltage GVjj of the first area 211 and the output of the first gate voltage GVj1 of the first area 211. In addition, the voltage supplying part 250 outputs the blank gate voltage GVB between the output of the k-th gate voltage GVkk of the second area 212 and the output of the first gate voltage GVk1.

Specifically, the voltage supplying part 250 outputs the first gate voltage GVj1 of the first area 211, the j-th gate voltage GVjj of the first area 211, the first gate voltage GVk1 of the second area 212, the k-th gate voltage GVkk of the second area 212 and the blank gate voltage GVB to the gate voltage adjusting part 260. In addition, the voltage supplying part 250 outputs the second to (j−1)-th gate voltages GVj2, . . . , GVjj−1 of the first area 211 to the first gate driving part 221, and outputs the second to (k−1)-th gate voltages GVk2, . . . , GVkk−1 of the second area 212 to the second gate driving part 222.

The gate voltage adjusting part 260 receives the first gate voltage GVj1 and the j-th gate voltage GVjj of the first area 211 from the voltage supplying part 250, and adjusts the first gate voltage GVj1 and the j-th gate voltage GVjj of the first area 211 to respectively output the adjusted first gate voltage AGVj1 and the adjusted j-th gate voltage AGVjj of the first area 211. Specifically, the gate voltage adjusting part 260 decreases the first gate voltage GVj1 and the j-th gate voltage GVjj of the first area 211 to respectively generate the adjusted first gate voltage AGVj1 and the adjusted j-th gate voltage AGVjj of the first area 211, and outputs the adjusted first gate voltage AGVj1 and the adjusted j-th gate voltage AGVjj of the first area 211.

In addition, the gate voltage adjusting part 260 receives the first gate voltage GVk1 and the k-th gate voltage GVkk of the second area 212 from the voltage supplying part 250, and adjusts the first gate voltage GVk1 and the k-th gate voltage GVkk of the second area 212 to respectively output the adjusted first gate voltage AGVk1 and the adjusted k-th gate voltage AGVkk of the second area 212. Specifically, the gate voltage adjusting part 260 decreases the first gate voltage GVk1 and the k-th gate voltage GVkk of the second area 212 to respectively generate the adjusted first gate voltage AGVk1 and the adjusted k-th gate voltage AGVkk of the second area 212, and outputs the adjusted first gate voltage AGVk1 and the adjusted k-th gate voltage AGVkk of the second area 212.

In addition, the gate voltage adjusting part 260 receives the blank gate voltage GVB from the voltage supplying part 250, and adjusts the blank gate voltage GVB to output the adjusted blank gate voltage AGVB. Specifically, the gate voltage adjusting part 260 decreases the blank gate voltage GVB to generate the adjusted blank gate voltage AGVB, and outputs the adjusted blank gate voltage AGVB.

The first gate driving part 221 outputs the first gate signals GSj1 of the first area 211 based on the adjusted first gate voltage AGVj1 of the first area 211, respectively outputs the second to (j−1)-th gate signals GSj2, . . . , GSjj−1 of the first area 211 based on the second to (j−1)-th gate voltages GVj1, . . . , GVjj−1 of the first area 211, outputs the j-th gate signal GSjj of the first area 211 based on the adjusted j-th gate voltage AGVjj of the first area 211, and outputs the blank gate signal GSB based on the adjusted blank gate voltage AGVB.

The second gate driving part 222 outputs the first gate signal GSk1 of the second area 212 based on the adjusted first gate voltage AGVk1 of the second area 212, respectively outputs the second to (k−1)-th gate signals GSk2, . . . , GSkk−1 of the second area 212 based on the second to (k−1)-th gate voltages GVk2, . . . , GVkk−1 of the second area 212, outputs the k-th gate signal GSkk of the second area 212 based on the adjusted k-th gate voltage AGVkk of the second area 212, and outputs the blank gate signal GSB based on the adjusted blank gate voltage AGVB.

Waveforms diagram of the first, second to (j−1)-th and j-th gate voltages GVj1, GVj2, . . . , GVjj−1, GVjj of the first area 211, the first, second to (k−1)-th and k-th gate voltages GVk1, GVk2, . . . , GVkk−1, GVkk of the second area 212 and the blank gate voltage GVB is substantially the same as the waveforms diagram of the first, second to (j−1)-th and j-th gate voltages GVj1, GVj2, . . . , GVjj−1, GVjj of the first area 111, the first, second to (k−1)-th and k-th voltages GVk1, GVk2, . . . , GVkk−1, GVkk of the second area 112 and the blank gate voltage GVB in FIG. 2A.

Waveforms diagram of the adjusted first gate voltage AGVj1 of the first area 211, the adjusted j-th gate voltage AGVjj of the first area 211, the adjusted first gate voltage AGVk1 of the second area 212, the adjusted k-th gate voltage AGVkk of the second area 212 and the adjusted blank gate voltage AGVB is substantially the same as the waveforms diagram of the adjusted first gate voltage AGVj1 of the first area 211, the adjusted j-th gate voltage AGVjj of the first area 211, the adjusted first gate voltage AGVk1 of the second area 212, the adjusted k-th gate voltage AGVkk of the second area 212 and the adjusted blank gate voltage AGVB in FIG. 2B.

Waveforms diagram of the first, second to (j−1)-th and j-th gate signals GSj1, GSj2, . . . , GSjj−1, GSjj of the first area 211, the first, second to (k−1)-th and k-th gate signals GSk1, GSk2, . . . , GSkk−1 and GSkk of the second area 212 and the blank gate signals GSB is substantially the same as the waveforms diagram of the first, second to (j−1)-th and j-th gate signals GSj1, GSj2, . . . , GSjj−1, GSjj of the first area 111, the first, second to (k−1)-th and k-th gate signals GSk1, GSk2, . . . , GSkk−1 and GSkk of the second area 112 and the blank gate signals GSB in FIG. 2C.

A method of driving a display panel performed by the display panel driving apparatus of FIG. 4 is substantially the same as the method of a display panel of FIGS. 3A and 3B.

A load of the display panel 210 when each of the first, second to (j−1)-th and j-th gate signals GSj1, GSj2, . . . , GSjj−1, GSjj of the first area 211 is applied to the display panel 210 is greater than a load of the display panel 210 when the blank gate signal GSB is applied to the display panel 210. Therefore, when the first gate driving part 221 directly receives the blank gate voltage GVB from the voltage supplying part 250 and outputs the blank gate signal GSB based on the blank gate voltage GVB, a level of the blank gate signal GSB may be greater than each of the levels of the first, second to (j−1)-th and j-th gate signals GSj1, GSj2, . . . , GSjj−1, GSjj of the first area 211.

In addition, when the level of the blank gate signal GSB is greater than each of the levels of the first, second to (j−1)-th and j-th gate signals GSj1, GSj2, . . . , GSjj−1, GSjj of the first area 211, each of the level of the first gate signal GSj1 of the first area 211 and the level of the j-th gate signal GSjj of the first area 211 outputted during the load period LOAD adjacent to the blank period BLANK may be greater than each of the levels of the second to (j−1)-th gate signals GSj2, . . . , GSjj−1 of the first area 211.

In addition, a load of the display panel 210 when each of the first, second to (k−1)-th and k-th gate signals GSk1, GSk2, . . . , GSkk−1, GSkk of the second area 212 is applied to the display panel 210 is greater than the load of the display panel 210 when the blank gate signal GSB is applied to the display panel 210. Therefore, when the second gate driving part 222 directly receives the blank gate voltage GVB from the voltage supplying part 250 and outputs the blank gate signal GSB based on the blank gate voltage GVB, the level of the blank gate signal GSB may be greater than each of levels of the first, second to (k−1)-th and k-th gate signals GSk1, GSk2, . . . , GSkk−1, GSkk of the second area 212.

In addition, when the level of the blank gate signal GSB is greater than each of the levels of the first, second to (k−1)-th and k-th gate signals GSk1, GSk2, . . . , GSkk−1, GSkk of the second area 212, each of the level of the first gate signal GSk1 of the second area 212 and the level of the k-th gate signal GSkk of the second area 211 outputted during the load period LOAD adjacent to the blank period BLANK may be greater than each of the levels of the second to (k−1)-th gate signals GSk2, . . . , GSkk−1 of the second area 212.

However, in the present exemplary embodiment, the gate voltage adjusting part 260 decreases the blank gate voltage GVB to generate the adjusted blank gate voltage AGVB, and the first gate driving part 221 outputs the blank gate signal GSB based on the adjusted blank gate voltage AGVB, therefore the level of the blank gate signal GSB may be substantially the same as each of the levels of the first, second to (j−1)-th and j-th gate signals GSj1, GSj2, . . . , GSjj−1, GSjj of the first area 211.

In addition, the gate voltage adjusting part 260 decreases the first gate voltage GVj1 and the j-th gate voltage GVjj of the first area 211 to respectively generate the adjusted first gate voltage AGVj1 and the adjusted j-th gate voltage AGVjj of the first area 211, and the first gate driving part 221 respectively outputs the first gate signal GSj1 and the j-th gate signal GSjj of the first area 211 based on the adjusted first gate voltage AGVj1 and the adjusted j-th gate voltage AGVjj of the first area 211, therefore each of the level of the first gate signal GSj1 of the first area 211 and the level of the j-th gate signal GSjj of the first area 211 may be substantially the same as each of the levels of the second to (j−1)-th gate signals GSj2, . . . , GSjj−1 of the first area 211.

In addition, the gate voltage adjusting part 260 decreases the blank gate voltage GVB to generate the adjusted blank gate voltage AGVB, and the second gate driving part 222 outputs the blank gate signal GSB based on the adjusted blank gate voltage AGVB, therefore the level of the blank gate signal GSB may be substantially the same as each of the levels of the first, second to (k−1)-th and k-th gate signals GSk1, GSk2, . . . , GSkk−1, GSkk of the second area 212.

In addition, the gate voltage adjusting part 260 decreases the first gate voltage GVk1 and the k-th gate voltage GVkk of the second area 212 to respectively generate the adjusted first gate voltage AGVk1 and the adjusted k-th gate voltage AGVkk of the second area 212, and the second gate driving part 222 respectively outputs the first gate signal GSk1 and the k-th gate signal GSkk of the second area 212 based on the adjusted first gate voltage AGVk1 and the adjusted k-th gate voltage AGVkk of the second area 212, therefore each of the level of the first gate signal GSk1 of the second area 212 and the level of the k-th gate signal GSkk of the second area 212 may be substantially the same as each of the levels of the second to (k−1)-th gate signals GSk2, . . . , GSkk−1 of the second area 212.

According to the present exemplary embodiment, the gate voltage adjusting part 260 decreases the blank gate voltage GVB outputted during the blank period BLANK. In addition, the gate voltage adjusting part 260 decreases the first gate voltage GVj1 and the j-th gate voltage GVjj of the first area 211 outputted during the load period LOAD adjacent to the blank period BLANK. In addition, the gate voltage adjusting part 260 decreases the first gate voltage GVk1 and the k-th gate voltage GVkk of the second area 212 outputted during the load period LOAD adjacent to the blank period BLANK. Therefore, each of the levels of the first, second to (j−1)-th and j-th gate signals GSj1, GSj2, . . . , GSjj−1, GSjj of the first area 211 applied to the display panel 210 during the load period LOAD, each of the levels of the first, second to (k−1)-th and k-th gate signals GSk1, GSk2, . . . , GSkk−1, GSkk of the second area 212 applied to the display panel 210 during the load period LOAD, and the level of the blank gate signal GSB outputted during the blank period BLANK may be substantially the same. Thus, data charge ratios of the pixels P in the display panel 210 as well as the pixels P adjacent to the boundary between the first area 211 and the second area 212 may be regular.

According to the method of driving a display panel, the display panel driving apparatus for performing the method and the display apparatus having the display panel driving apparatus, data charge rations of pixels in the display panel as well as pixels adjacent to a boundary between a first area and a second area of the display panel may be regular. Thus, display quality of the display apparatus may be improved.

The foregoing is illustrative of the present inventive concept and is not to be construed as limiting thereof. Although a few exemplary embodiments of the present inventive concept have been described, those skilled in the art will readily appreciate that many modifications are possible in the exemplary embodiments without materially departing from the novel teachers and advantages of the present inventive concept. Accordingly, all such modifications are intended to be included within the scope of the present inventive concept as defined in the claims. In the claims, means-plus-function clauses are intended to cover the structures described herein as performing the recited function and not only structural equivalents but also equivalent structures. Therefore, it is to be understood that the foregoing is illustrative of the present inventive concept and is not to be construed as limited to specific exemplary embodiments disclosed, and that modifications to the disclosed exemplary embodiments, as well as other exemplary embodiments, are intended to be included within the scope the appended claims. The present inventive concept is defined by the following claims, with equivalents of the claims to be included therein.

What is claimed is:

1. A method of driving a display panel, the method comprising:

respectively outputting first to j-th, where j is a natural number, gate signals to first to j-th gate lines disposed on a first area of the display panel during a load period when an image is displayed on the display panel due to an output of a data signal to the display panel;

adjusting a blank gate voltage during a blank period between load periods to generate an adjusted blank gate voltage;

generating a blank gate signal based on the adjusted blank gate voltage; and outputting the blank gate signal.

2. The method of claim 1, wherein the generating the adjusted blank gate voltage comprises decreasing the blank gate voltage.

3. The method of claim 1, wherein the outputting the first to j-th gate signals comprises:

adjusting a first gate voltage to generate an adjusted first gate voltage;

generating a first gate signal based on the adjusted first gate voltage; and outputting the first gate signal to the first gate line disposed on the first area of the display panel.

4. The method of claim 3, wherein the generating the adjusted first gate voltage comprises decreasing the first gate voltage.

5. The method of claim 1, wherein the outputting the first to j-th gate signals comprises:

adjusting a j-th gate voltage to generate an adjusted j-th gate voltage;

generating the j-th gate signal based on the adjusted j-th gate voltage; and outputting the j-th gate signal to the j-th gate line disposed on the first area of the display panel.

6. The method of claim 5, wherein the generating the adjusted j-th gate voltage comprises decreasing the j-th gate voltage.

7. The method of claim 1, wherein the outputting the first to j-th gate signals comprises:

respectively generating second to (j−1)-th gate signals from second to (j−1)-th gate voltage; and respectively outputting the second to (j−1)-th gate signals to second to (j−1)-th gate lines disposed on the first area of the display panel.

8. The method of claim I, further comprising:

respectively outputting first to k-th, where k is a natural number, gate signal to first to k-th gate lines disposed on a second area different from the first area of the display panel during the load period.

9. The method of claim 8, wherein the outputting the first to k-th gate signals comprises:

adjusting a first gate voltage to generate an adjusted first gate voltage;

generating a first gate signal based on the adjusted first gate voltage; and outputting the first gate signal to the first gate line disposed on the second area of the display panel.

10. The method of claim 9, wherein the generating the adjusted first gate voltage comprises decreasing the first gate voltage.

11. The method of claim 8, the outputting the first to k-th gate signals comprises:

adjusting a k-th gate voltage to generate an adjusted k-th gate voltage;

generating the k-th gate signal based on the adjusted k-th gate voltage; and outputting the k-th gate signal to the k-th gate line disposed on the second area of the display panel.

12. The method of claim 11, wherein the generating the adjusted k-th gate voltage comprises decreasing the k-th gate voltage.

13. The method of claim 8, wherein the outputting the first to k-th gate signals comprises:

respectively generating second to (k−1)-th gate signals from second to (k−1)-th gate voltage; and respectively outputting the second to (k−1)-th gate signals to second to (k−1)-th gate lines disposed on the second area of the display panel.

14. A display panel driving apparatus comprising:

a gate voltage adjusting part configured to adjust a blank gate voltage to generate an adjusted blank gate voltage during a blank period between load periods when an image is displayed on a display panel due to an output of a data signal to the display panel;

a first gate driving part configured to respectively output first to j-th, where j is a natural number, gate signals to first to j-th gate lines disposed on a first area of the display panel during the load period, and configured to output a blank gate signal by generating the blank gate signal based on the adjusted blank gate voltage;

a first data driving part configured to output the data signal to a data line disposed on the first area of the display panel; and a timing controlling part configured to output a gate start signal and a gate clock signal to the first gate driving part, and configured to output a data start signal and a data clock signal to the first data driving part.

15. The display panel driving apparatus of claim 14, wherein the gate voltage adjusting part is configured to adjust a first gate voltage to generate an adjusted first gate voltage and is configured to adjust a j-th gate voltage to generate an adjusted j-th gate voltage, and the first gate driving part is configured to generate the first gate signal based on the adjusted first gate voltage and is configured to generate the j-th gate signal based on the adjusted j-th gate voltage.

16. The display panel driving apparatus of claim 14, further comprising:

a second gate driving part configured to respectively output first to k-th, where k is a natural number, gate signals to first to k-th gate lines disposed on a second area different from the first area of the display panel during the load period, and configured to output the blank gate signal by generating the blank gate signal based on the adjusted blank gate voltage; and a second data driving part configured to output the data signal to a data line disposed on the second area of the display panel.

17. The display panel driving apparatus of claim 16, wherein the gate voltage adjusting, part is configured to adjust a first gate voltage to generate an adjusted first gate voltage and is configured to adjust a k-th gate voltage to generate an adjusted k-th gate voltage, and the second gate driving part is configured to generate the first gate signal based on th adjusted first gate voltage and is configured to generate the k-th gate signal based on the adjusted k-th gate voltage.

18. A display apparatus comprising:

a display panel configured to display an image; and a display panel driving apparatus comprising:

a gate voltage adjusting part configured to adjust a blank gate voltage to generate an adjusted blank gate voltage during a blank period between load periods when the image is displayed on the display panel due to an output of a data signal to the display panel;

a first gate driving part configured to respectively output first to j-th, where j is a natural number, gate signals to first to j-th gate lines disposed on a first area of the display panel during the load period and configured to output a blank gate signal by generating the blank gate signal based on the adjusted blank gate voltage;

a first data driving part configured to output the data signal to a data line disposed on the first area of the display panel;

a second gate driving part configured to respectively output first to k-th, where k is a natural number, gate signals to first to k-th gate lines disposed on a second area different from the first area of the display panel during the load period and configured to output the blank gate signal by generating the blank gate signal based on the adjusted blank gate voltage;

a second data driving part configured to output the data signal to a data line disposed on the second area of the display panel; and a timing controlling part configured to output a gate start signal and a gate clock signal to the first gate driving part and the second gate driving part and configured to output a data start signal and a data clock signal to the first data driving part and the second data driving part.

19. The display apparatus of claim 18, Wherein the first to j-th gate lines are sequentially disposed toward a boundary between the first area and the second area, and the first to k-th gate lines are sequentially disposed toward the boundary between the first area and the second area.

20. The display apparatus of claim 18, wherein the first to j-th gate lines are sequentially disposed from an area adjacent to a boundary between the first area and the second area, and the first to k-th gate lines are sequentially disposed from the area adjacent to the boundary between the first area and the second area.

* * * * *